US011445758B2

(12) United States Patent
Guo et al.

(10) Patent No.: US 11,445,758 B2
(45) Date of Patent: Sep. 20, 2022

(54) ELECTRONIC CIGARETTE ASSEMBLY

(71) Applicant: SHENZHEN ITSUWA TECHNOLOGY CO LIMITED, Shenzhen (CN)

(72) Inventors: Xiaoping Guo, Shenzhen (CN); Ruyun Guo, Shenzhen (CN)

( * ) Notice: Subject to any disclaimer, the term of this patent is extended or adjusted under 35 U.S.C. 154(b) by 414 days.

(21) Appl. No.: 16/840,666

(22) Filed: Apr. 6, 2020

(65) Prior Publication Data

US 2020/0337375 A1 Oct. 29, 2020

(30) Foreign Application Priority Data

Apr. 24, 2019 (CN) ..... 201930192723.X
Oct. 12, 2019 (CN) ..... 201930555927.5
Nov. 29, 2019 (CN) ..... 201922121033.2

(51) Int. Cl.
*A24F 40/40* (2020.01)
*A24F 40/46* (2020.01)

(52) U.S. Cl.
CPC ..... *A24F 40/46* (2020.01)

(58) Field of Classification Search
None
See application file for complete search history.

(56) References Cited

U.S. PATENT DOCUMENTS 5,343,858 A * 9/1994 Winefordner ..... B63C 11/2227 128/205.24
2014/0182610 A1* 7/2014 Liu ..... A24F 40/42 131/329
2020/0337375 A1* 10/2020 Guo ..... A24F 40/40
2022/0175047 A1* 6/2022 Fung ..... A24F 40/40

* cited by examiner

*Primary Examiner* — James Harvey
(74) *Attorney, Agent, or Firm* — Clement Cheng

(57) ABSTRACT

An electronic cigarette includes a housing, wherein the housing is elongate and has a head end disposed toward the user and a tail end extending away from the user. The housing comprises a bottom cover and a shell section. A battery is retained within the housing. An atomizer tank cartridge fits to the housing. An electrical heating apparatus powered by the battery. A groove is formed between the bottom cover and the shell section. A trim piece is mounted between the bottom cover and shell section. The trim piece is a hot-melt material, and connected to the groove via a heating process. The trim piece passes around an external periphery of the housing. The trim piece is an epoxy resin material. The housing further comprises a removable mouth-piece cover attached at a head end.

14 Claims, 4 Drawing Sheets

ELECTRONIC CIGARETTE ASSEMBLY

This application claims priority from China design patent 201922121033.2 entitled Electronic Cigarette by inventor Goo Xiaoping and applicant Shenzhen Itsuwa Technology Co Limited. filed Nov. 29, 2019.

This application claims priority from China patent 201930192723X entitled Electronic Cigarette by inventor Guo Ruyun and filed Apr. 24, 2019 by applicant Shenzhen Itsuwa Technology Co Limited. previously named Shenzhen Itsuwa Electron Co Limited.

This application claims priority from China patent 201930555927.5 entitled Charging Box by inventor Guo Ruyun and filed Oct. 12, 2019 by applicant Shenzhen Itsuwa Technology Co Limited. previously named Shenzhen Itsuwa Electron Co Limited.

TECHNICAL FIELD

The utility model relates to the technical field of electronic cigarettes, in particular to an electronic cigarette assembly structure.

DISCUSSION OF RELATED ART

An E-cigarette is an electronic product that attempts to mimic cigarettes with the same appearance, smoke, taste and feel as cigarettes. Users can inhale nicotine and other vapors by atomization. Most of the electronic cigarettes on the market are assembled structures that use metal shells. To improve the metal shell aesthetics, decorative parts are usually designed between the shell and the bottom cover, and the decorative parts are mostly plastic parts.

The shell and the plastic parts can be adhesively bonded together such as by pressing or gluing the bottom cover to the shell components. In the industry industry, sometimes incomplete assembly and deformation or looseness of parts arise due to problems with precision and tolerance matching. This affects structural rigidity, reduces service life, and increases production failure rate which reduces production efficiency.

SUMMARY OF INVENTION

It is an object of the present invention to improve the assembly structure of the electronic cigarette.

An electronic cigarette assembly structure includes a casing and a bottom cover integrally formed with the casing. The casing and the bottom cover are separated from each other. A decorative groove is provided, and the decorative groove is provided with a decorative piece.

Alternatively, in a further improvement of the present invention, a material of the decorative member is a hot-melt material, and the decorative member is integrated with the decorative groove through a heating process. According to a further improvement of the present invention, the decorative groove has a ring shape. A detachably connected nozzle cover can be provided at an end of the housing far from the bottom cover. A smoke outlet can be provided at one end of the casing near the mouthpiece cover, and the mouthpiece cover can be provided with a mouthpiece corresponding to the mouthpiece.

The electronic cigarette assembly structure includes a casing and a bottom cover integrally formed with the casing, wherein a decorative groove is formed between the casing and the bottom cover, and a decorative piece is provided on the decorative groove. Through the above-mentioned design, the structural rigidity is improved, the service life is prolonged, and the defective rate is reduced. It has the characteristics of simple and reasonable structure and convenient use. It can meet the needs of users and has high practical value. Preferably, the decorative piece provides an anti-scratch protection by bearing on an external surface to protect the housing.

An electronic cigarette includes a housing, wherein the housing is elongate and has a head end disposed toward the user and a tail end extending away from the user. The housing comprises a bottom cover and a shell section. A battery is retained within the housing. An atomizer tank cartridge fits to the housing. An electrical heating apparatus powered by the battery. A groove is formed between the bottom cover and the shell section. A trim piece is mounted between the bottom cover and shell section. The trim piece is a hot-melt material, and connected to the groove via a heating process. The trim piece passes around an external periphery of the housing. The trim piece is an epoxy resin material. The housing further comprises a removable mouthpiece cover attached at a head end.

The electronic cigarette assembly structure optionally includes a cartridge socket for receiving the atomizer tank. The cartridge socket is formed on the housing. The atomizer tank also fits into a movable mouthpiece. The removable mouthpiece and the cartridge socket encapsulate the atomizer tank.

The atomizer tank has a tank magnet that attracts a battery bottom magnet mounted on a socket base formed in a cartridge socket. The cartridge socket is formed on the housing.

The atomizer tank has a first electrical contact and a second electrical contact that are electrically connected to a heater mounted in the electrical heating apparatus. The first electrical contact and the second electrical contact make electrical connection to a pair of spring electrodes mounted on the socket base. A second tank magnet can be aligned to attract a second battery bottom magnet that is mounted to the socket base. The first battery bottom magnet and the second battery bottom magnet when latched to the first tank magnet in the second tank magnet overcome a spring bias of the pair of spring electrodes. The pair of spring electrodes have helical coil springs for making electrical contact.

The present invention will be further described below with reference to the accompanying drawings and specific embodiments of the specification.

Figure 1:
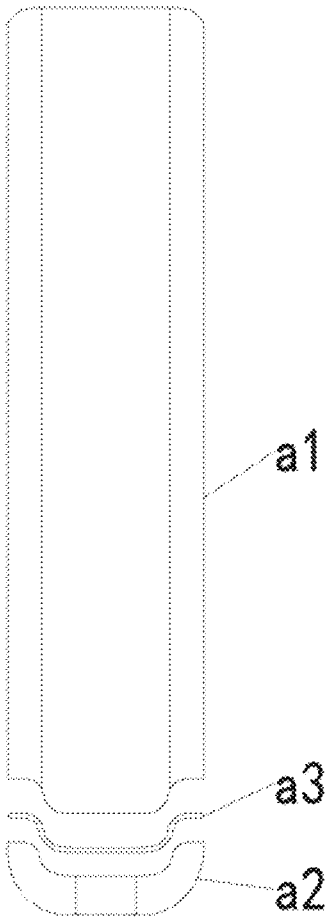
FIG. 1 is a schematic diagram of the entire structure of the prior art.

The following call out list of elements can be a useful guide referencing the elements of the drawings.

a1 shell section
a2 bottom cover section
a3 trim section
1 housing
2 bottom cover
3 decorative groove

4 trim piece
5 mouthpiece cover
6 tank outlet
7 mouthpiece outlet
8 shoulder stop
9 retainer slot
10 filling port
11 atomizer tank
21 mouthpiece cover lower edge
22 mouthpiece housing end
23 atomizer tank flat surface
24 mouthpiece cover flat inside surface
25 rounded inside protrusion
31 battery holder
32 battery cavity
33 lower port
34 contact opening
41 microphone gasket
42 microphone gasket nub
43 microphone gasket side opening
45 gasket socket
46 battery silicone gasket
47 battery silicone gasket groove
48 upper opening
49 magnet mounting location
51 spring electrode
52 electrical contact
53 control board
54 first battery bottom magnet
55 second battery bottom magnet
56 battery
60 heater assembly
61 air conduit
62 air conduit intake
63 first electrical contact
64 second electrical contact
65 first tank magnet
66 second tank magnet
67 housing air conduit
68 housing air inlet
69 socket base
85 cartridge socket
86 tail end
87 head end
88 heater

DETAILED DESCRIPTION OF THE PREFERRED EMBODIMENT

The terms "length", "width", "upper", "lower", "front", "rear", "left", "right", "vertical" The orientations or positional relationships indicated by, "horizontal", "top", "bottom", "inner", "outer" are based on the orientations or positional relationships shown in the drawings, and are only for the convenience of describing the utility model and simplifying the description rather than indicating or implying that the device or element referred to must have a specific orientation, be constructed and operate in a specific orientation as a limitation of the present invention.

Figure 2:
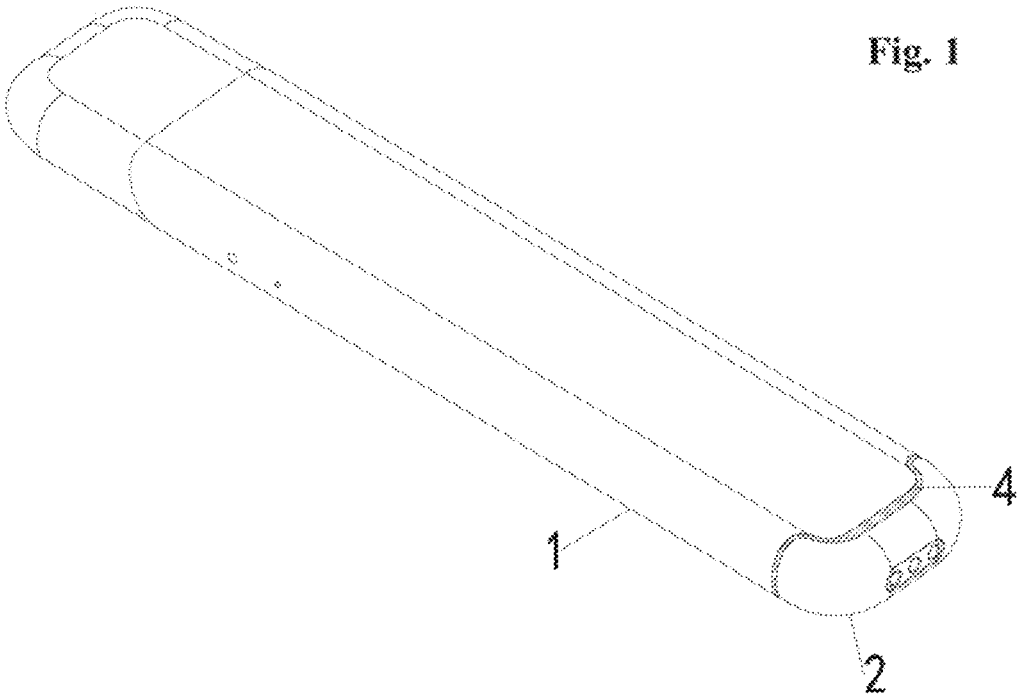
FIG. 2 is a schematic diagram of the overall structure of the utility model.
Figure 3:
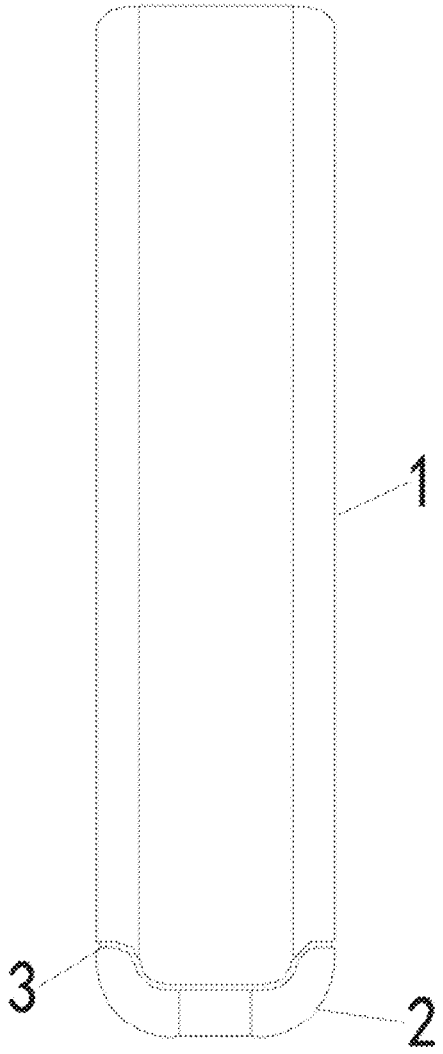
FIG. 3 is a partial structural schematic diagram of the present invention.

As seen in FIG. 1, the electronic cigarette includes a shell section a1, a bottom cover section a2, and a trim section a3 mounted between the shell section a1, the bottom cover section a2. The trim section can be a grooved inlay trim. As seen in FIG. 2, the shell section a1 can be formed as a housing 1, the bottom cover section a2 include a bottom cover 2, and trim section a3 can be a fused trim piece 4. Instead of a fused trim piece as seen in FIG. 2, the trim section a3 can be formed as a decorative groove 3 as seen in FIG. 3. The decorative groove 3 is formed between the bottom cover 2 and the housing 1 and can be formed by trim piece having a groove in it, or by omitting the trim piece. The trim section a3 provides a seamless connection between the shell section a1 and the bottom cover section a2 in a continuous loop that travels 360° around a periphery of the shell section a1. Therefore, the plastic connector structure can be formed before or after connection of the shell section a1 to the bottom cover section a2.

Figure 4:
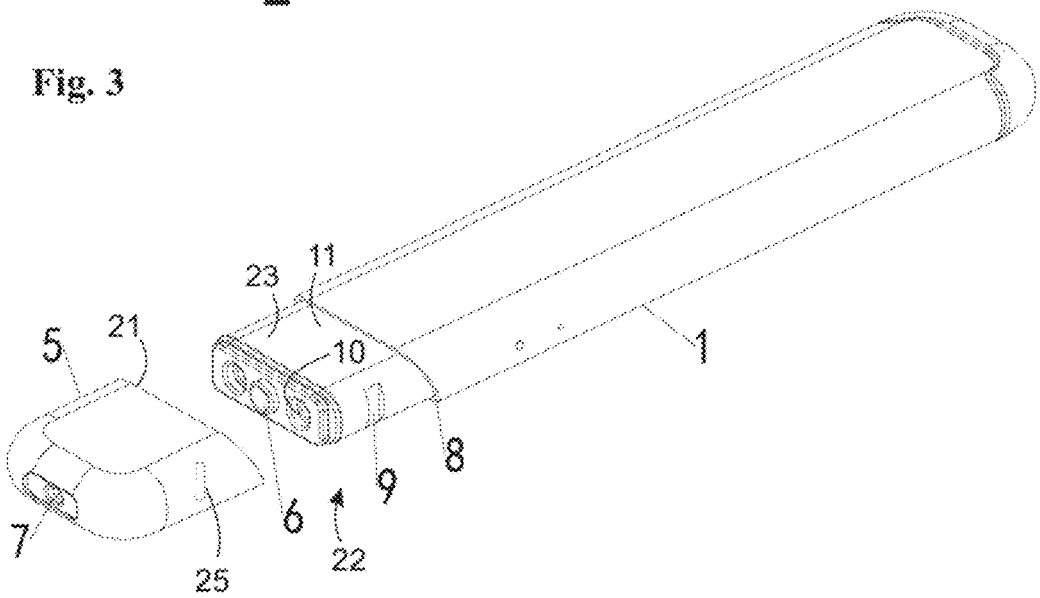
FIG. 4 is a schematic diagram of an explosion structure of the present invention.

The housing 1 generally has a tail end 86 facing away from the user and a head end 87 facing towards the user. As seen in FIG. 4, the electronic cigarette assembly structure has a housing 1 formed as a casing and a bottom cover 2 integrally formed with the housing 1, wherein the housing 1 and the bottom cover 2 have a trim with a decorative groove 3 arranged between. The trim piece 4 can be installed in the decorative groove 3. The material of the decorative trim piece 4 can be a hot-melt material, so that the decorative trim piece 4 are integrated with the decorative grooves 3 through a heating process. The decorative trim piece 4 can also be made of a plastic epoxy resin that is transparent, or a plastic epoxy resin that is initially transparent, but then receiving a dye for an opaque or a translucent appearance.

The heating process may be an in-mold injection or a lacquering process, and in either case, the decorative trim piece 4 can be fused on the surface of the decorative groove 3. In addition, the printed decorative material 4 can also be put into an injection mold, where an elastomeric material such as silicone is injected into the mold so that the resin and the sheet can be integrated into a solidified molding. The silicone can be a high density silicone gasket. The trim piece installation is preferably performed at the same time as injection molding, so that both the housing 1 and the trim piece 4 can be integrated into one body, and simultaneously receive printing or other surface treatment such as laser engraving.

Further, one end of the housing 1 remote from the bottom cover 2 is provided with a detachably connected suction nozzle cover formed as a mouthpiece cover 5. An end of the housing 1 near the mouthpiece cover 5 includes has a tank outlet 6. The housing outlet 6 is a smoke outlet or vapor outlet that produces vapor or smoke in an airstream. The mouthpiece cover 5 has a smoking port 7 corresponding to and aligned to the tank outlet 6, so as to facilitate the placement of the mouthpiece cover 5 over the tank outlet 6. The airstream occurring when a user operates from the mouthpiece outlet 7 is continuing to and passes the tank outlet 6.

As seen in FIG. 4, the decorative groove 3 is formed in the shape of a ring. Specifically, the surface of the housing 1 near the tank outlet 6 has a blocking portion formed as a shoulder stop 8. When the mouthpiece cover 5 covers the end of the housing 1 and a mouthpiece cover lower edge 21 abuts the shoulder stop 8 to provide support for the mouthpiece cover 5. A retainer slot 9 is formed between the tank outlet 6 and the shoulder stop 8. The retainer slot 9 engages to a buckle or latch formed on an inside surface of the mouthpiece cover 5. The latch may be integrally formed with the inside surface of the mouthpiece cover 5 as an rounded inside protrusion 25 shaped to conform to be received into the retainer slot 9 when the mouthpiece cover 5 is in closed position. Preferably, the mouthpiece cover 5 has a mouthpiece cover flat inside surface 24 that abuts and slides upon an atomizer tank flat surface 23 near a mouthpiece housing end 22.

The atomizer tank 11 becomes a part of the housing when inserted into the housing. The atomizer tank has a filling port 10 that can be permanently closed if disposable or selectively plugged with a removable seal if reusable.

The mouthpiece cover 5 and the housing 1 are detachably connected at the retainer slot 9 and the rounded inside protrusion 25. When the mouthpiece cover 5 is contaminated with bacteria and dust from environmental exposure and use, a user can remove the cover and clean it.

Figure 5:
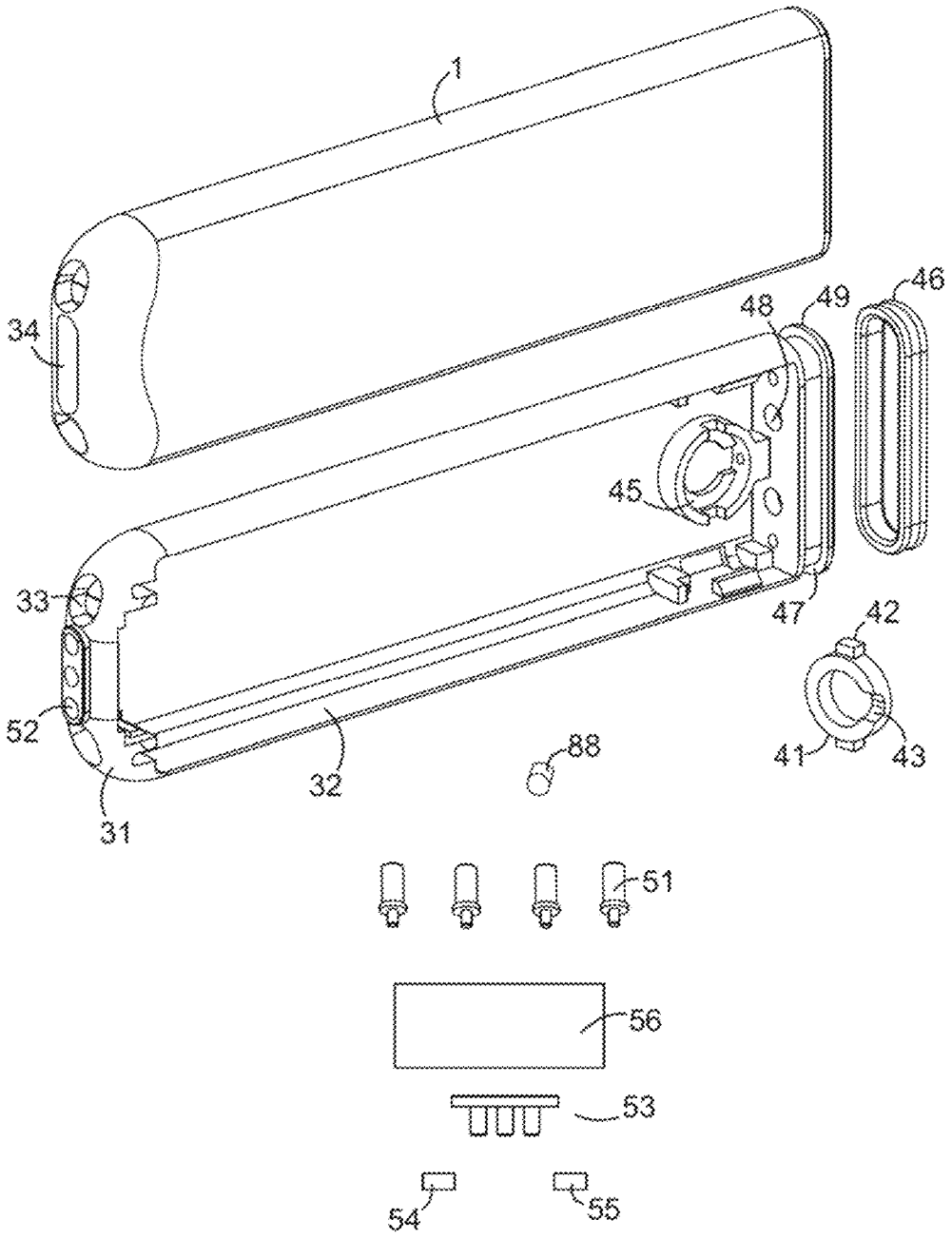
FIG. 5 is an exploded assembly.

As seen in FIG. 5, the housing 1 may have a contact opening 33 and be configured to fit over a battery holder 31. The battery holder 31 battery cavity 32 that receives a battery 56. The battery holder 31 may have a lower court 33 for airflow to the battery cavity 32. The electrical contact 52 protrudes through the contact opening 33. The battery 56 is connected to a control board 53 and the control board 53 operates a resistance heater that introduces vapor to the flow of air to the user. The resistance heater an be a black ceramic that reaches a maximum temperature of 1300° Celsius.

The electrical contact a spring-loaded electrode 51 formed as a coil spring housed in a barrel that biases an electrode to make electrical contact. Three spring loaded electrodes 51 can be mounted in the electrical contact 52. The control board 53 can sense when the mouthpiece cover 5 is removed such as by electrical contact, or by magnet means so that the control board 53 deactivates the battery power to the electrical resistance heater 88. For example, an upper opening 48 can receive a spring electrode 51. A first battery bottom magnet 54 and a second battery bottom magnet 55 can be mounted in a magnet mounting location 49.

To provide an improved seal, a battery silicone gasket groove 47 can receive a battery silicone gasket 46. A microphone gasket 41 can install to a gasket socket 45. The gasket socket 45 may have notches for receiving microphone gasket nubs 42. Also, the microphone gasket 41 can have a microphone gasket side opening 43. The microphone gasket retains a microphone which functions as an airflow sensor.

Figure 6:
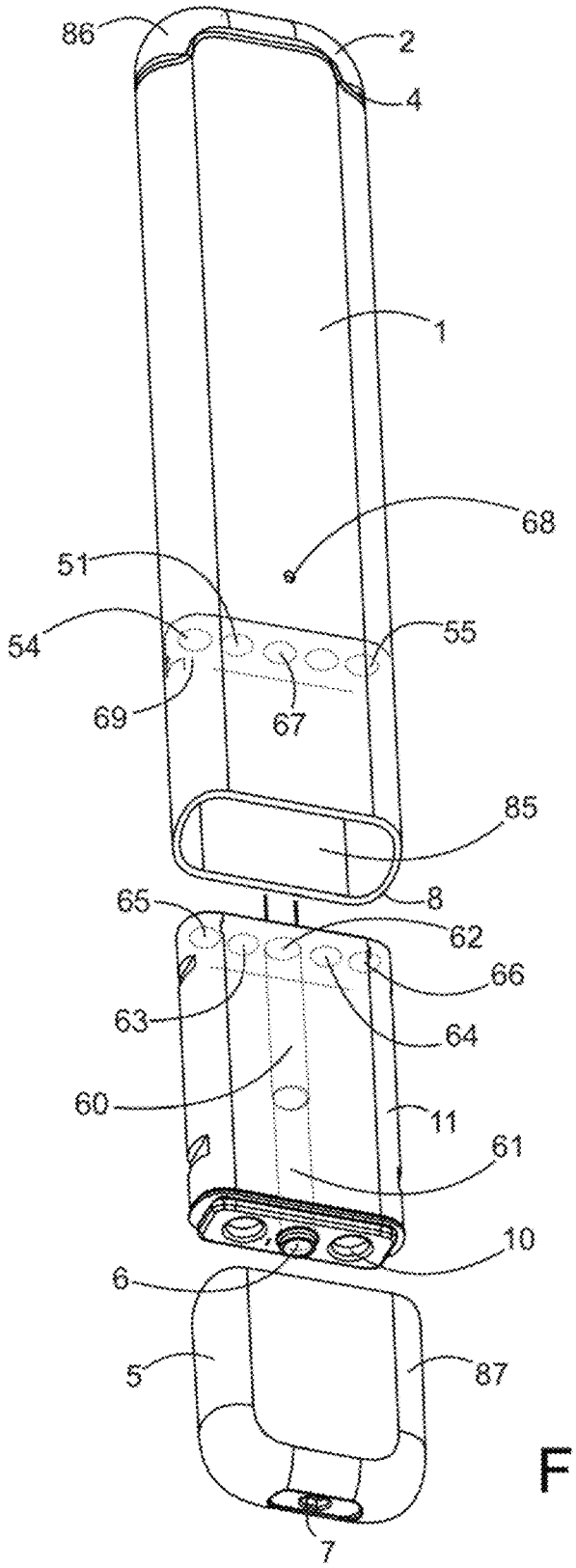
FIG. 6 is an exploded view of the present invention.

As seen in FIG. 6, the atomizer tank 11 is modular and fits within socket of the housing 1. The socket has a socket base 69. On the socket base, a pair of spring electrodes 51 provide a first and second electrical contact. Also, on the socket base, a housing air conduit 67 communicates with the housing air inlet 68. The first battery bottom magnet 54, and the second battery bottom magnet 55 are mounted on the socket base 69. The socket base 69 is preferably generally flat for receiving the flat bottom surface of the atomizer tank 11. The flat bottom surface of the atomizer tank 11 has a first tank magnet 65 that engages the first battery bottom magnet 54 to overcome the coil spring bias of the spring electrode. The first battery bottom magnet 55 is spaced from the central midline of the housing 1 equidistant in relation to the second battery bottom magnet distal spacing to provide a balanced two point magnetic latch.

The second tank magnet 66 mounted on the atomizer tank 11 latches to the second battery bottom magnet 55 which biases one of the pair of spring electrodes 51 to be pressed against the second electrical contact 64. Because the heater assembly 60, which retains the heater 88, is electrically connected to the first electrical contact 63 and the second electrical contact 64 the removal of the atomizer tank 11 deactivates the heater assembly 60. The pair of spring electrodes 51 are electrically connected to the battery via an airflow switch mounted at the housing area inlet 68. The airflow sensor switch which can be formed as a microphone, activates and completes the circuit when a user aspirates from the mouthpiece cover 5 which draws air through the mouthpiece outlet 7. The housing air conduit 67 communicates with the housing air inlet 68. The air conduit 61 extends from the heater assembly 60 to the tank outlet 6. The heater assembly 60.

The housing has a cartridge socket 85 that receives the atomizer tank 11. The atomizer tank fits into a cartridge socket formed on the housing. The atomizer tank also fits into a movable mouthpiece. The removable mouthpiece and the cartridge socket encapsulate the atomizer tank.

In this disclosure, terms such as "connected" and "fixed" should be understood in a broad sense, unless otherwise specified and limited. For example, they can be fixed connections or removable. Also, connected or integrated can be in a mechanical or electrical sense and may be directly connected or indirectly connected through an intermediate medium or can the internal connection of two elements or the interaction between two elements. The specific description of the present invention by the above embodiments is only for further explanation of the present invention, and should not be understood as limiting the scope of protection of the present invention.

The invention claimed is:

1. An electronic cigarette assembly structure comprising:

a. a housing, wherein the housing is elongate and has a head end disposed toward the user and a tail end extending away from the user, wherein the housing comprises a bottom cover and a shell section;

b. battery retained within the housing;

c. an atomizer tank cartridge fitting to the housing;

d. an electrical heating apparatus powered by the battery;

e. a groove formed between the bottom cover and the shell section; and f. a trim piece mounted between the bottom cover and shell section.

2. The electronic cigarette assembly structure of claim 1, wherein the trim piece is a hot-melt material, and connected to the groove via a heating process.

3. The electronic cigarette assembly structure of claim 1, wherein the trim piece passes around an external periphery of the housing.

4. The electronic cigarette assembly structure of claim 1, wherein the trim piece is an epoxy resin material.

5. The electronic cigarette assembly structure of claim 1, wherein the housing further comprises a removable mouthpiece cover attached at a head end.

6. The electronic cigarette assembly structure of claim 1, wherein the atomizer tank fits into a cartridge socket formed on the housing, wherein the atomizer tank also fits into a removable mouthpiece, wherein the removable mouthpiece and the cartridge socket encapsulate the atomizer tank.

7. The electronic cigarette assembly structure of claim 1, wherein the atomizer tank has a tank magnet that attracts a first battery bottom magnet mounted on a socket base formed in a cartridge socket, wherein the cartridge socket is formed on the housing.

8. The electronic cigarette assembly structure of claim 7, wherein the atomizer tank has a first electrical contact and a second electrical contact that are electrically connected to a heater mounted in the electrical heating apparatus, the first electrical contact and the second electrical contact make electrical connection to a pair of spring electrodes mounted on the socket base.

9. The electronic cigarette assembly structure of claim 8, further comprising a second tank magnet aligned to attract a second battery bottom magnet that is mounted to the socket base, wherein the first battery bottom magnet and the second battery bottom magnet when latched to the first tank magnet and the second tank magnet overcome a spring bias of the pair of spring electrodes, wherein the pair of spring electrodes have helical coil springs for making electrical contact.

10. The electronic cigarette assembly structure of claim 9, wherein the trim piece is a hot-melt material, and connected to the groove via a heating process.

11. The electronic cigarette assembly structure of claim 9, wherein the trim piece passes around an external periphery of the housing.

12. The electronic cigarette assembly structure of claim 9, wherein the trim piece is an epoxy resin material.

13. The electronic cigarette assembly structure of claim 9, wherein the housing further comprises a removable mouthpiece cover attached at a head end.

14. The electronic cigarette assembly structure of claim 9, wherein the atomizer tank fits into the cartridge socket formed on the housing, wherein the atomizer tank also fits into a movable mouthpiece, wherein the removable mouthpiece and the cartridge socket encapsulate the atomizer tank.

* * * * *